US006739785B2

(12) United States Patent
Moor

(10) Patent No.: US 6,739,785 B2
(45) Date of Patent: May 25, 2004

(54) EXTENDED WIDTH NOTEBOOK SYSTEM

(75) Inventor: Marc L. Moor, Oakwood, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 09/809,542

(22) Filed: Mar. 15, 2001

(65) Prior Publication Data

US 2001/0028822 A1 Oct. 11, 2001

Related U.S. Application Data

(60) Provisional application No. 60/189,665, filed on Mar. 15, 2000.

(51) Int. Cl.[7] ..... B42F 13/00
(52) U.S. Cl. ..... 402/79; 281/38
(58) Field of Search ..... 402/79, 70, 73; 281/38, 31, 45, 16

(56) References Cited

U.S. PATENT DOCUMENTS

| | | | | |
|---|---|---|---|---|
| 970,341 | A | | 9/1910 | Kucera |
| 1,222,010 | A | | 4/1917 | Mack |
| 1,505,079 | A | | 8/1924 | Mills |
| 3,315,684 | A | | 4/1967 | Karl |
| 3,913,740 | A | | 10/1975 | Bisberg |
| 4,127,690 | A | | 11/1978 | Schleifenbaum et al. |
| 4,395,059 | A | | 7/1983 | Russell, III |
| 4,492,487 | A | | 1/1985 | Spear |
| 4,773,676 | A | | 9/1988 | Showering |
| 4,802,692 | A | | 2/1989 | Stryd |
| 4,934,740 | A | * | 6/1990 | Drake ..... 281/16 R |
| 5,318,325 | A | | 6/1994 | Ipsen ..... 283/81 |
| 5,487,568 | A | | 1/1996 | Ipsen ..... 283/81 |
| 5,524,998 | A | | 6/1996 | Schwartz |
| 5,639,124 | A | | 6/1997 | Jung ..... 283/36 |
| 5,713,606 | A | | 2/1998 | Kleinberg et al. ..... 281/42 |
| 5,836,711 | A | | 11/1998 | Stewart |
| 5,855,395 | A | | 1/1999 | Foote et al. ..... 283/67 |
| 5,909,979 | A | * | 6/1999 | Winzen ..... 402/79 |
| 5,915,874 | A | | 6/1999 | Wilson et al. ..... 402/79 |
| 5,918,908 | A | | 7/1999 | Barnett et al. ..... 283/56 |
| 5,924,736 | A | * | 7/1999 | Russo ..... 402/79 |
| 5,948,494 | A | | 9/1999 | Levin ..... 428/43 |
| 5,997,207 | A | * | 12/1999 | Robinson ..... 402/79 |
| 6,431,780 | B2 | | 8/2002 | Moor et al. ..... 402/79 |

FOREIGN PATENT DOCUMENTS

| | | |
|---|---|---|
| CH | 488571 | 5/1970 |
| DE | 862596 | 1/1953 |
| DE | 29513501 | 10/1995 |
| FR | 1017133 | 12/1952 |

* cited by examiner

*Primary Examiner*—Willmon Fridie, Jr.
(74) *Attorney, Agent, or Firm*—Thompson Hine LLP

(57) ABSTRACT

A notebook including a plurality of sheets, each sheet having a width, an inner edge and a tear guide line that extends generally parallel to and spaced apart from an inner edge of the sheet. The notebook further includes at least one divider pocket having a pocket having a width substantially equal to the width of the sheets. Each sheet can be torn along its tear guide line to produce a torn sheet having a width significantly less than the width of the at least one pocket such that a number of torn sheets can be received in the at least one pocket.

30 Claims, 2 Drawing Sheets

EXTENDED WIDTH NOTEBOOK SYSTEM

This application claims priority to U.S. Provisional Application Serial No. 60/189,665, filed Mar. 15, 2000, the contents of which are hereby incorporated by reference. The present invention is directed to a notebook having a plurality of pockets and removable sheets, wherein the torn sheets can be received in the pockets of the notebook.

BACKGROUND OF THE INVENTION

Notebooks are widely used by students and professionals as a storage device and a source of paper. The notebooks may include a plurality of loose paper sheets that are bound together by a binding mechanism. However, the pockets of most existing notebooks can receive a relatively low number of loose papers. Thus, the user may be required to carry an auxiliary storage folder to store papers.

SUMMARY OF THE INVENTION

The present invention is a notebook having a plurality of bound sheets that can be separated from the notebook. The notebook has at least one divider pocket having a pocket, and a the sheets are shaped such that a large number of torn sheets can be received in the pocket. The torn sheets have a narrow width relative the pockets of the notebook, so that the pockets can receive relatively large volumes of the torn sheets.

In one embodiment, the invention is a notebook including a plurality of sheets, each sheet having a width, an inner edge and a tear guide line that extends generally parallel to and spaced apart from an inner edge of the sheet. The notebook further includes at least one pocket divider having a pocket having a width substantially equal to the width of the sheets. Each sheet can be torn along its tear guide line to produce a torn sheet having a width significantly less than the width of the at least one pocket such that a number of torn sheets can be received in the at least one pocket.

Other objects and advantages of the present invention will be apparent from the following description and the accompanying drawings.

DETAILED DESCRIPTION

Figure 1:
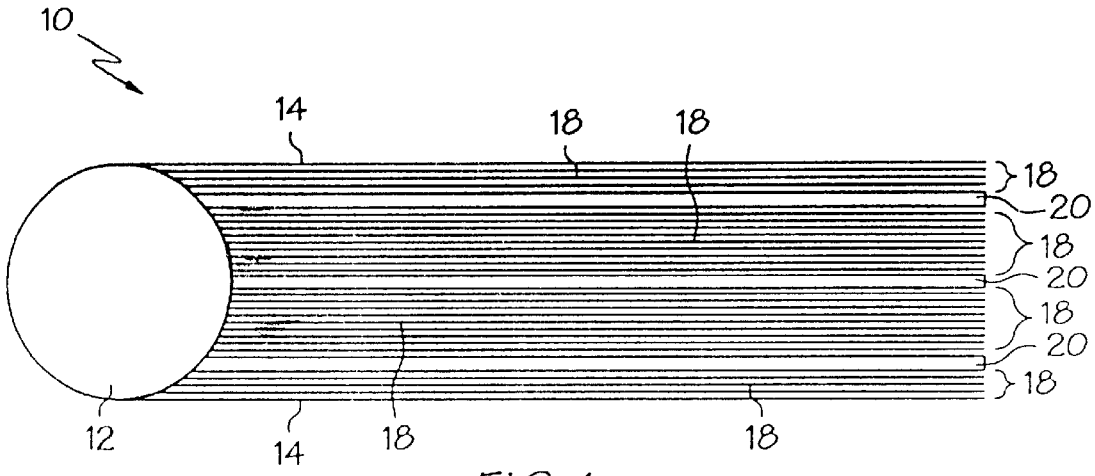
FIG. 1 is a side view of one embodiment of the notebook of the present invention.

As shown in FIG. 1, the notebook 10 of the present invention includes a top cover 14, a bottom cover 16, and a plurality of paper sheets or other media 18 located between the covers. The binder also includes a plurality of pocket dividers 20 spaced throughout the width of the notebook. Each pocket divider 20 has a pocket 30 (FIG. 3) formed between a backing portion 36 and a lower portion 34 of the pocket divider 20. The notebook 10 may also include a binding mechanism, generally designated 12, for binding the sheets 18 and pocket dividers 20 together. The binding mechanism 12 may be nearly any binding mechanism, including but not limited to a spiral binder, binding spine, three-ring binder, adhesives, etc. Each pocket divider 20 preferably has a width B that is about the same as the untorn sheets 18 received in the binding mechanism 12.

Figure 2:
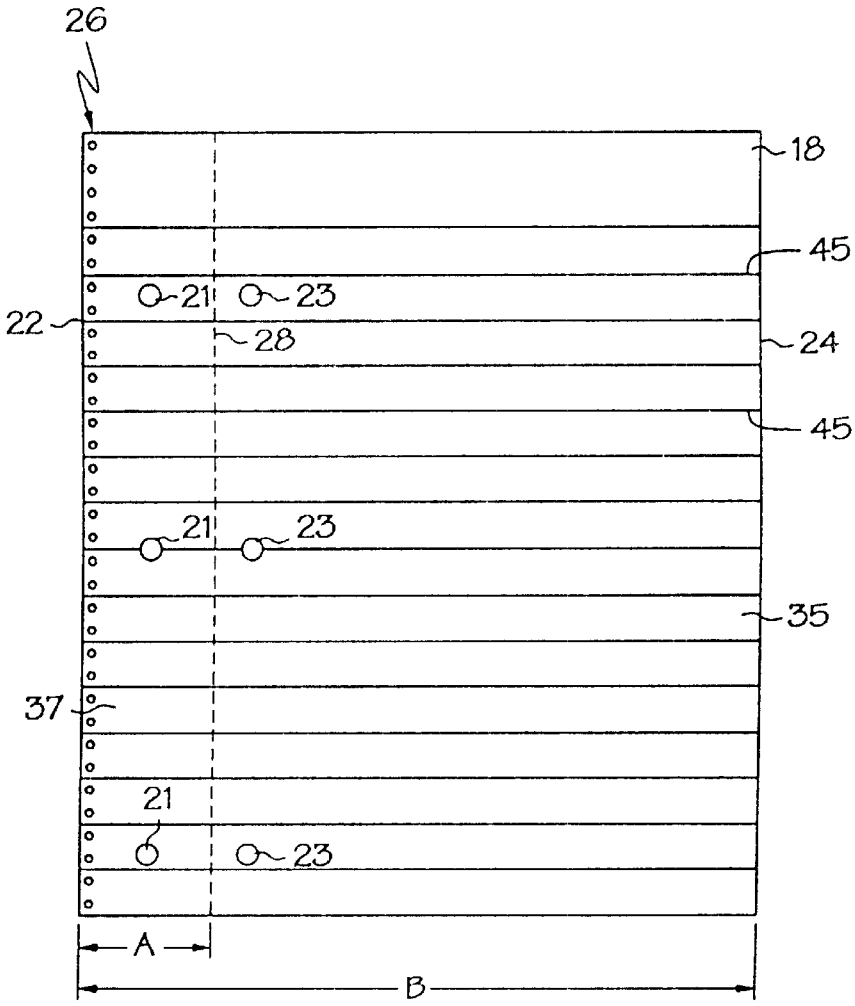
FIG. 2 is a top view of a paper sheet of the notebook of FIG. 1.

As shown in FIG. 2, each sheet 18 of the notebook 10 includes an inner edge 22, an outer edge 24, and a set of attachment holes or binding holes 26 extending along the inner edge 22. Each binding hole 26 is shaped to receive a turn of the coil binding mechanism 12 to attach the paper sheet 18 to the spiral binder 12. However, the binding holes 26 may be omitted or replaced with other shapes or sizes of holes when other binding mechanisms are used. The paper sheet 18 also includes a perforation line 28 that is laterally spaced from the inner edge 22 of the sheet. The perforation line 28 is spaced away from the inner edge 22 of the sheet 18 by a distance A, such that when a sheet 18 is torn along the perforation line 28, a torn sheet 18' (FIG. 3) has a width that is significantly less than an untorn sheet. Thus, the perforation line 28 divides the sheet 18 into a wide portion 35 and a narrow portion 37, and the wide portion 35 can be separated and removed from the binding mechanism while the narrow portion 37 remains bound. Any other structure besides a perforation line 28 that can enable the sheet 18 to be torn along a predefined path may also be used in place of the perforation line, including but not limited to a fold, an area of weakness formed in the sheet 18, etc. (together, termed a "tear guide line").

Each sheet 18 may include a set of laterally extending guide lines 45. Because the narrow portion 37 is quite wide as compared to many existing notebooks, it may be easier or tempting for the user to write on the narrow portion 37 of the sheet 18. However, if the user writes on the narrow portion 37, the material written on the narrow portion 37 will be separated from the sheet when the sheet is torn along its perforation line 28. Thus, in one embodiment, the narrow portion 37 and the wide portion 35 have different appearances to convey to the user that the wide portion 35 can be separated from the narrow portion 27. For example, in one embodiment the narrow 37 and wide 35 portions has different colors (i.e., the wide portion 35 may be a standard color, such as white, and the narrow portion 37 may be colored, such as yellow). In another embodiment, only the wide portion 35 includes the generally laterally-extending guide lines 45, and the narrow portion 37 is unlined, or includes lining having a different spacing, line thickness, etc. These features help to prevent a user from writing indica on the narrow portion 37 due to the coloring or unlined features of the narrow portion 37. Nearly any feature that distinguishes the wide portion 35 from the narrow portion 37 may be used without departing from the scope of the invention. In yet another embodiment, the narrow portion 37 includes a coloring (i.e., a dark color), coating, or the like that makes it difficult for a user to write on the narrow portion.

Figure 3:
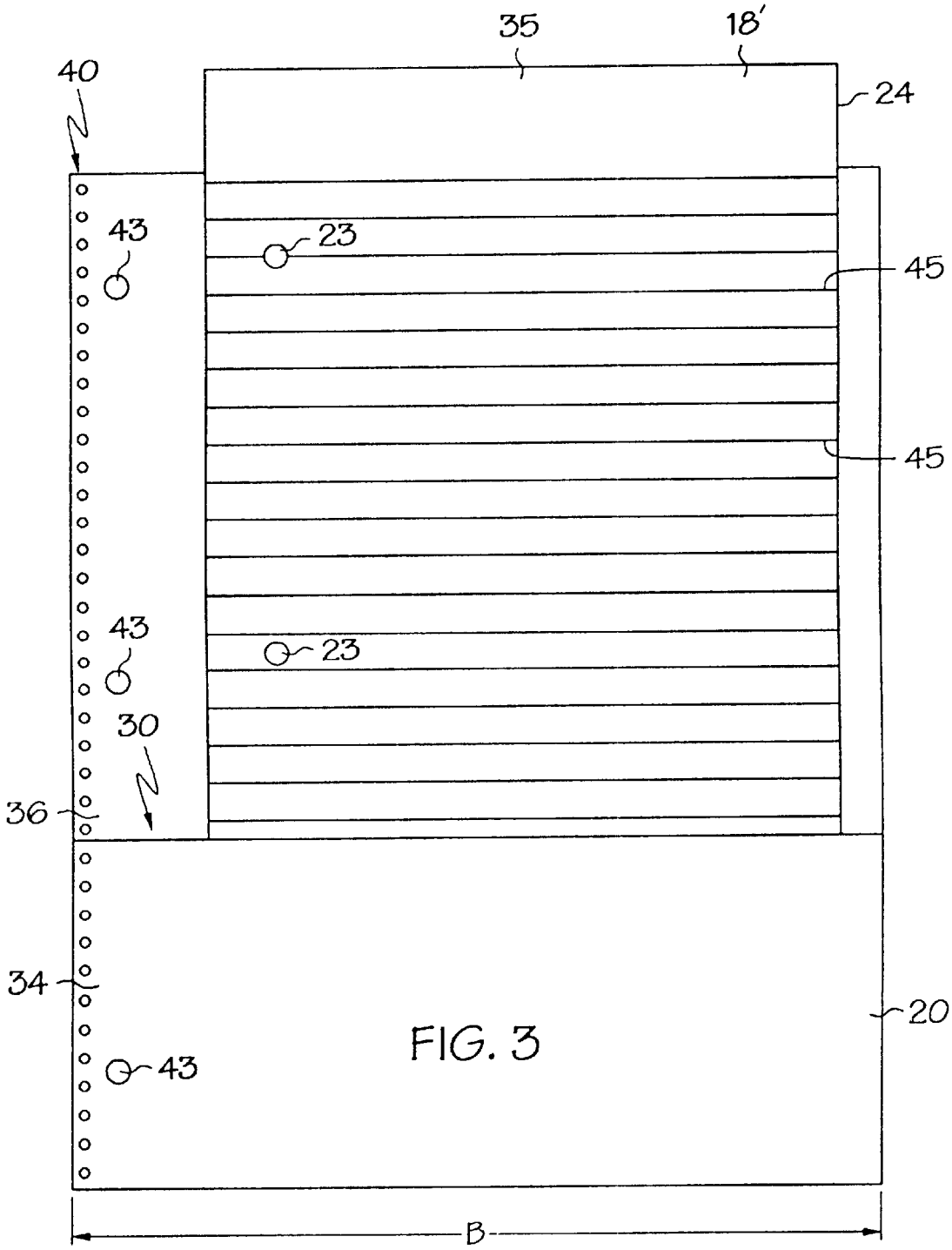
FIG. 3 is a top view of a pocket of the notebook of FIG. 1, with the pocket receiving a torn sheet therein.

A torn sheet 18' that is removed from the notebook 10 may be sized to be easily received in the pocket 30 pocket divider 20. As shown in FIG. 3, the torn sheet 18' has a width that is significantly narrower than pocket 30 of the pocket divider 20. In one embodiment, the wide portion 37 is about 2.5 to about 15 times wider than the narrow portion 37, preferably about 10 times wider. In this case, the width of the torn sheet 18' may be about 90% of the width of the untorn sheet 18 or the pocket 20.

After the paper 18 is torn along its perforation 28 and uncoupled from the notebook 10, the torn sheet 18' may have a standard width (i.e., 8½"×11"), although other sizes of the torn sheet are equally acceptable. Because the pocket 30 of the pocket divider 20 is significantly wider than the torn sheet 18', the pocket 30 can accommodate a large number of sheets 18', as the lower portion 34 of the pocket divider 20 can be pulled away from the backing portion 36 of the pocket divider 20 to accommodate the sheets. In contrast, the pockets in many prior art notebooks may be approximately the same width as the torn sheets, which limits the number of sheets which can be accommodated by the pockets.

Returning to FIG. 2, each paper sheet 18 may also include a first set of binder holes 21 and a second set of holes 23. The narrow portion 37 may be about 2–4 times as wide as the holes 21, 23. The first set of binder holes 21 enable the notebook 10 to be mounted into a three ring binder passed through the first set of binder holes 21. The second set of binder holes 23 are located on the torn sheet 18' such that the torn sheet 18' can be received in a three ring binder. The second set of binder holes 23 may be laterally aligned with the first set of binder holes 21, or have a similar spacing pattern, such that the torn sheet 18' can be received in the same three ring binder that receives the notebook 10. The pocket dividers 20 may also include a set of holes 40 so that the pocket dividers 20 can be mounted on the binding mechanism 12. The pocket dividers 20 may also include a set of binder holes 43 to receive the rings of a three ring binder.

Having described the invention in detail and by reference to the preferred embodiments thereof, it will be apparent that modifications and variations thereof are possible without departing from the scope of the invention.

What is claimed is:

1. A notebook comprising:

a plurality of sheets, each sheet having a width, an inner edge and a tear guide line that extends generally parallel to and spaced apart from said inner edge of said sheet, each sheet including a first and a second set of holes, each of said set of holes being shaped to receive a binding mechanism therethrough each sheet including a third set of holes extending generally parallel to and spaced apart from said inner edge of said sheet, said third set of holes being laterally spaced apart from said first and second set of holes, wherein said first and third sets of holes are located on one side of said tear guide line and said second set of holes is located on the other side of said tear guide line, and wherein said tear guide line, said first set of holes and said third set of holes are each located generally adjacent to said inner edge; and at least one pocket divider having a pocket having a width substantially equal to the width of said sheets, wherein each sheet can be torn along its tear guide line to produce a torn sheet having a width significantly less than the width of said at least one pocket such that a number of torn sheets can be received in said at least one pocket.

2. The notebook of claim 1 wherein said notebook includes a binding mechanism for binding said plurality of sheets and said at least one pocket divider together.

3. The notebook of claim 2 wherein said binding mechanism is a spiral binder.

4. The notebook of claim 1 wherein said first and second sets of holes are laterally aligned.

5. The notebook of claim 1 wherein said tear guide line extends between said first and second sets of holes.

6. The notebook of claim 1 wherein said first set of holes is shaped to receive a three ring binder therethrough and said second set of holes is shaped to receive a spiral binding mechanism therethrough.

7. The notebook of claim 6 wherein said third set of holes is shaped to receive a three ring binder therethrough.

8. The notebook of claim 1 wherein at least one of said set of holes is shaped to receive a three ring binder therethrough, and wherein each tear guide line divides each sheet into a wide portion and a narrow portion, and wherein said narrow portion is about 2–4 times wider than said set of holes.

9. The notebook of claim 1 wherein said at least one pocket divider includes a set of holes formed therethrough, said set of holes being shaped to receive a binding mechanism therethrough.

10. The notebook of claim 1 wherein each tear guide line divides each sheet into a wide portion and a narrow portion, and wherein said wide portion is no more than about five times wider than said narrow portion.

11. The notebook of claim 1 wherein said first set of holes includes a set of attachment holes extending along said inner edge for attaching said sheet to a spiral binding mechanism, and wherein said second set of holes includes a set of binder holes for receiving a three ring binder therethrough, said tear guide line extending between said set of binder holes and said set of attachment holes.

12. The notebook of claim 1 wherein each tear guide line divides each sheet into a wide portion and a narrow portion, and wherein said wide portion includes indicia thereon, and wherein said narrow portions lacks said indicia.

13. The notebook of claim 1 wherein each tear guide line divides each sheet into a wide portion and a narrow portion, and wherein said wide portion includes a plurality of generally laterally extending guide lines and wherein said narrow portion is unlined.

14. The notebook of claim 1 wherein each tear guide line divides each sheet into a wide portion and a narrow portion, and wherein said narrow portion has a first color on its outer surface and said wide portion has a second color on its outer surface.

15. The notebook of claim 1 wherein each tear guide line divides each sheet into a wide portion and a narrow portion, and wherein said narrow portion includes a coloring or coating that discourages a user from writing on said inner portion.

16. A method for using a notebook comprising the steps of:

providing a notebook having a plurality of sheets, each sheet having a width, an inner edge and a tear guide line that extends generally parallel to and spaced apart from said inner edge of said sheet, each sheet including a first, second and third set of holes extending generally parallel to and spaced apart from said inner edge of said sheet, said third set of holes being laterally spaced apart from said first and second set of holes, wherein said first and third sets of holes are located on one side of said tear guide line and said second set of holes is located on the other side of said tear guide line, and wherein said tear guide line, said first set of holes and said third set of holes are each located generally adjacent to said inner edge and at least one divider pocket having a pocket having a width substantially equal to the width of said sheets;

tearing a sheet along its tear guide line to produce a torn sheet having a width less than about ⅘ of the width of said at least one pocket such that a number of torn sheets can be received in said at least one pocket; and locating said torn sheet in said pocket.

17. A notebook comprising:

a plurality of sheets, each sheet having a width, an inner edge and a tear guide line that extends generally parallel to and spaced apart from said inner edge of said sheet, each tear guide line dividing the associated sheet into a wide portion and a narrow portion such that each wide portion is no more than about five times wider than the associated narrow portion wherein each sheet includes a first, second and third set of holes extending generally parallel to and spaced apart from said inner edge of said sheet, said third set of holes being laterally spaced apart from said first and second set of holes, wherein said first and third sets of holes are located on one side of said tear guide line and said second set of holes is located on the other side of said tear guide line, and wherein said tear guide line, said first set of holes and said third set of holes are each located generally adjacent to said inner edge; and at least one pocket divider having a pocket having a width substantially equal to the width of said untorn sheets, wherein each sheet can be torn along its tear guide line to produce a torn sheet having a width significantly less than the width of said at least one pocket such that a number of torn sheets can be received in said at least one pocket.

18. The notebook of claim 17 wherein each wide portion is no more than about 3.5 times wider than the associated narrow portion.

19. The notebook of claim 1 wherein each sheet is a loose leaf sheet.

20. The method of claim 16 wherein each sheet is a loose leaf sheet.

21. The notebook of claim 17 wherein each sheet is a loose leaf sheet.

22. The notebook of claim 1 wherein at least three edges of each sheet are not directly attached to any adjacent sheets.

23. The method of claim 16 wherein at least three edges of each sheet are not directly attached to any adjacent sheets.

24. The notebook of claim 17 wherein at least three edges of each sheet are not directly attached to any adjacent sheets.

25. The notebook of claim 1 wherein said top and bottom edges of each sheet are not directly attached to any adjacent sheets.

26. The method of claim 16 wherein said top and bottom edges of each sheet are not directly attached to any adjacent sheets.

27. The notebook of claim 17 wherein said top and bottom edges of each sheet are not directly attached to any adjacent sheets.

28. The notebook of claim 4 wherein said first set of holes has a one-to-one correspondence with said second set of holes, and wherein each sheet includes a plurality of longitudinally extending areas in which no holes are located, each longitudinally extending area extending between adjacent holes of each set of holes, each sheet having corresponding, generally laterally aligned longitudinally extending areas.

29. The notebook of claim 1 wherein said third set of holes is located between said tear guide line and said inner edge.

30. The notebook of claim 17 wherein said first set of holes is generally laterally aligned with said second set of holes such that said first set of holes has a one-to-one correspondence with said second set of holes, and wherein each sheet includes a plurality of longitudinally extending areas in which no holes are located, each longitudinally extending area extending between adjacent holes of each set of holes, each sheet having corresponding, generally laterally aligned longitudinally extending areas.

* * * * *